US007023413B1

(12) United States Patent
Terashima et al.

(10) Patent No.: US 7,023,413 B1
(45) Date of Patent: Apr. 4, 2006

(54) MEMORY CONTROLLER AND LIQUID CRYSTAL DISPLAY APPARATUS USING THE SAME

(75) Inventors: Yoshihiro Terashima, Hiratsuka (JP); Yukihiko Sakashita, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/177,572

(22) Filed: Oct. 23, 1998

(30) Foreign Application Priority Data

Oct. 24, 1997 (JP) ..... 9-292905

(51) Int. Cl.
*G09G 3/36* (2006.01)

(52) U.S. Cl. ..... 345/98; 345/100

(58) Field of Classification Search ..... 345/98, 345/88, 90, 509, 197, 198, 530–574, 519
See application file for complete search history.

(56) References Cited

U.S. PATENT DOCUMENTS

| | | | | |
|---|---|---|---|---|
| 4,745,485 | A * | 5/1988 | Iwasaki | 358/236 |
| 4,864,402 | A * | 9/1989 | Ebihara et al. | 358/160 |
| 5,794,016 | A * | 8/1998 | Kelleher | 345/505 |
| 5,900,857 | A * | 5/1999 | Kuwata et al. | 345/100 |
| 5,905,483 | A * | 5/1999 | Yuki | 345/98 |
| 5,909,205 | A * | 6/1999 | Furuhashi et al. | 345/98 |
| 5,959,601 | A * | 9/1999 | Ho et al. | 348/95 |
| 5,959,640 | A * | 9/1999 | Rudin et al. | 345/521 |
| 5,977,943 | A * | 11/1999 | Mano et al. | 345/98 |
| 6,108,015 | A * | 8/2000 | Cross | 345/519 |
| 6,115,020 | A * | 9/2000 | Taguchi et al. | 345/99 |
| 6,329,997 | B1 * | 12/2001 | Wu et al. | 345/519 |

FOREIGN PATENT DOCUMENTS

| | | |
|---|---|---|
| JP | 58-016343 | 1/1983 |
| JP | 60-159789 | 8/1985 |
| JP | 63-240620 | 10/1988 |
| JP | 2-033672 | 2/1990 |
| JP | 4-259079 | 9/1992 |
| JP | 5-158447 | 6/1993 |
| JP | 6-275069 | 9/1994 |

* cited by examiner

*Primary Examiner*—Xiao Wu
*Assistant Examiner*—Kevin M. Nguyen
(74) *Attorney, Agent, or Firm*—Fitzpatrick, Cella, Harper & Scinto

(57) ABSTRACT

A system can be realized by using a single frame memory, that is costly, to allow data write and data read operations continuously without suspending the video signal input. Such a memory controller comprises a serial/parallel converter section for converting serial input data into parallel data, an FIFO memory section for temporarily storing converted data, a memory section connected to the FIFO memory section to store data for a frame and a second FIFO memory section for temporarily storing the data read out from the frame memory section. The data bit width of said memory section is made equal to n times of the bit width of said input data so that data for a number of frames up to as many as (n-2) times of the number of input pixels can be read out of said memory section for said input data while the frequency of accessing said memory section can be reduced to a half or less than a half of the video signal input frequency.

2 Claims, 4 Drawing Sheets

FRAME MEMORY TIMING IN FIG. 1

MEMORY CONTROLLER AND LIQUID CRYSTAL DISPLAY APPARATUS USING THE SAME

BACKGROUND OF THE INVENTION

1. Field of the Invention

This invention relates to a memory controller adapted to temporarily store input video signals and read them out as occasion calls and also to a liquid crystal display apparatus using such a control.

2. Related Background Art

Known systems for temporarily storing video signals input from, for example, a personal computer and reading them out as occasion calls operate in a manner as described below by referring to FIG. 2 of the accompanying drawings. Firstly, the video input through input terminal 5 for the first frame is temporarily stored in frame memory 1 selected by demultiplexer 9. Then, the demultiplexer 9 switches to frame memory 8 to store the video input for the second frame there. At the same time, multiplexer 10 selects the frame memory 1 and reads out the video input for the first frame from there to output terminal 6.

Then, the demultiplexer 9 switches back to the frame memory 1 to store another video signal there and, at the same time, the multiplexer 10 selects the frame memory 8 and reads out the video input stored there to the output terminal 6. In this way, video signals are output continuously on a frame by frame basis by using two frame memories.

When a same image is to be displayed twice for flicker prevention and/or other purposes, each video signal is read out twice from the frame memory storing it at a rate twice as high as the rate of receiving image signals.

However, with such an arrangement, at least two frame memories, which is costly, have to be used to raise the cost of the entire system. When an image signal is read out twice, the rate of reading image signals is required to be twice as high as that of storing them in frame memories but it will be impossible to realize such a high rate particularly when image signals have to be received at an enormously high rate to improve the resolution of the displayed image.

Known techniques for controlling frame memories include the following.

Japanese Patent Application Laid-Open No. 6-275069 describes a method of carrying out a serial/parallel conversion for each input signal before it is written into a memory and then the signal read out from the memory is subjected to a parallel/serial conversion before it is output in order to achieve an FIFO operation. Japanese Patent Application Laid-Open Nos. 58-16343 and 60-159789 describe a technique of interposing an FIFO memory between an image memory and a parallel/serial converter. Japanese Patent Application Laid-Open No. 63-240620 describes a display technique using a buffer between an image memory and a parallel/serial converter. Japanese Patent Application Laid-Open No. 4-259079 describes an image reader comprising an FIFO memory and a parallel/serial converter. Japanese Patent Application Laid-Open No. 5-158447 describes a technique of improving the signal transfer rate by arranging an FIFO memory in a display data transfer section for transferring signals from a memory to a liquid crystal display in order to prevent flickers from appearing on the display screen. Finally, Japanese Patent Application Laid-Open No. 2-33672 describes an FIFO memory for inputting data to and outputting data from a serial read/write port.

However, it is not possible to realize a continuous signal writing/reading operation by means of a memory having a relatively small memory capacity with any of the above described known techniques.

SUMMARY OF THE INVENTION

In view of the above identified existing technological problem, it is therefore the object of the present invention to provide a technique of continuously writing signals into and reading signals from a memory.

According to the invention, the above object is achieved by providing a memory controller comprising a serial/parallel converter section to be used for converting serial input data into parallel data, an FIFO memory section for temporarily storing converted data, a memory section connected to the FIFO memory section to store data for a frame and another FIFO memory section for temporarily storing the data read out from the frame memory section.

With the above arrangement, the operation of writing data into and reading data from the frame memory section can be conducted continuously if the memory has a capacity only for a frame and a frame memory having a relatively low operating speed can be used for the operation to reduce the total cost of an image display system comprising such a memory controller.

DETAILED DESCRIPTION OF THE PREFERRED EMBODIMENTS

First Embodiment

Now, a first embodiment of memory controller according to the invention will be described by referring to FIG. 1.

Figure 1:
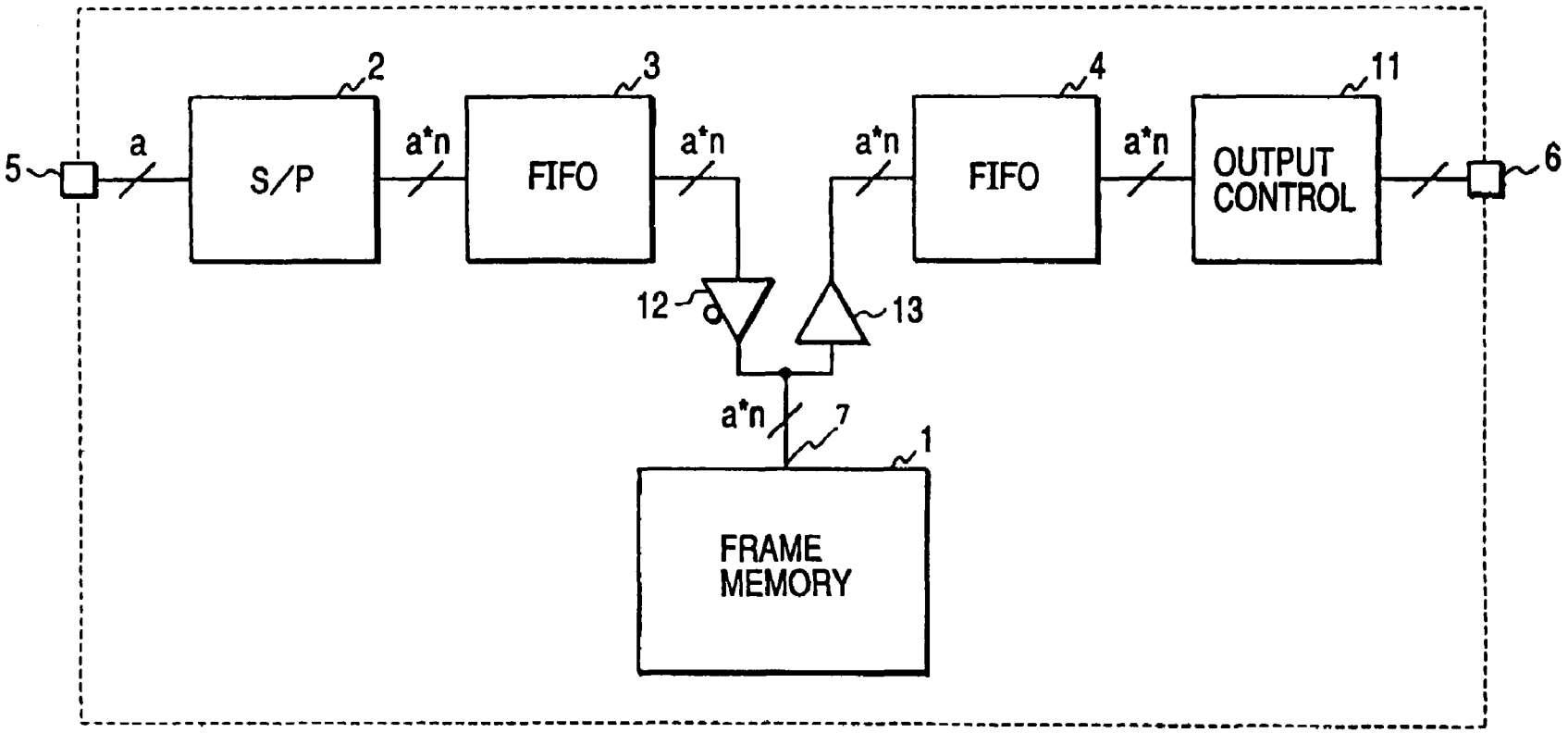
FIG. 1 is a schematic block diagram of an embodiment of memory controller according to the invention.
Figure 2:
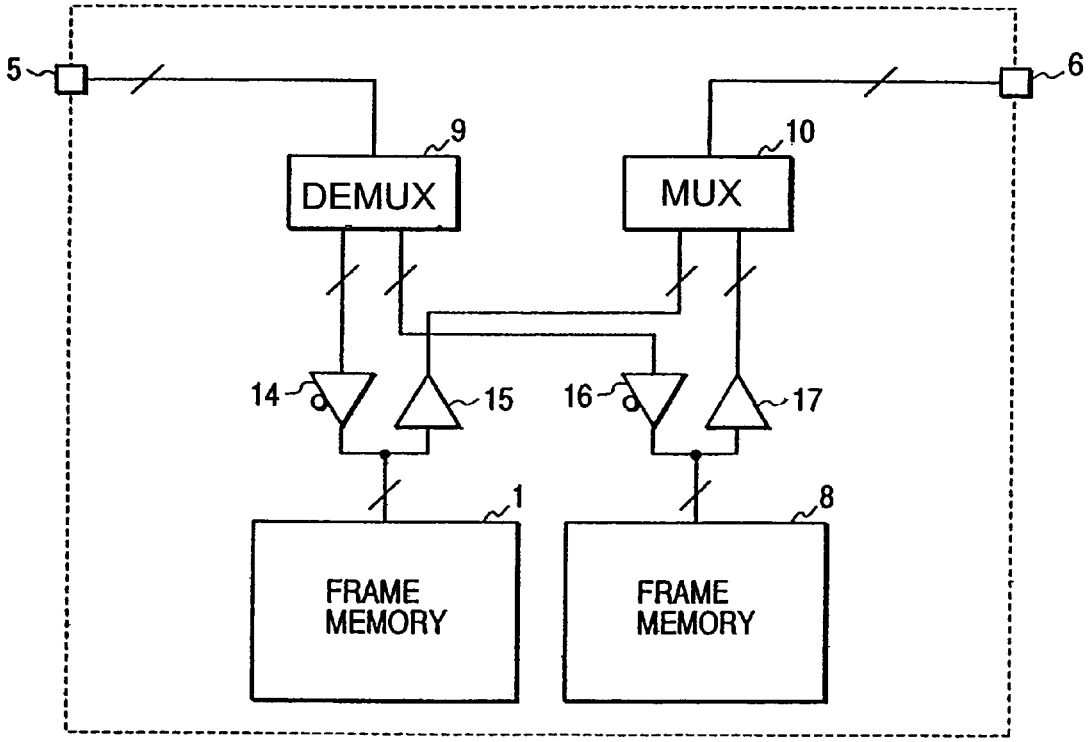
FIG. 2 is a schematic block diagram of a known memory controller of the category under consideration.

Referring to FIG. 1, the illustrated embodiment of memory controller comprises an input terminal 5 for receiving a-bit serial digital video signals, an S/P converter section 2 for converting serial digital video signals into axn-bit parallel video signals, an FIFO memory section 3 having a predetermined capacity for temporarily storing a parallel video signal, a buffer 12 having a switch for receiving the video signal of the FIFO memory section 3 and transmitting it as output signal, a frame memory section 1 having a predetermined capacity sufficient for storing at least a quantity of signal good for a frame out of the axn-bit video signal, an another buffer 13 for receiving the output of the frame memory section 1, another FIFO memory section 4 for temporarily storing the video signal from the buffer 13 and an output control section 11 for receiving the axn-bit video signal from the FIFO memory section 4 and converting it into serial video signals on a time series basis.

In a memory controller having the above described configuration, the frame memory 1 has a feature of continuously accessible in synchronism with a clock and may typically be an SDRAM. The bit width of the input/output data terminal of the frame memory section 1 is equal to n times of the bit width of the video signal input terminal 5. If, for example, the input terminal 5 is adapted to receive R, G and B serial signals, each of which is an 8-bit signal, the input/output data terminal 7 has at least a bit width of 24 bits as n is at least equal to 3. In this embodiment, the input terminal 5 has a bit width of 8 bits and the input/output data terminal has a bit width of 8×4=32.

The 8-bit data entered to the memory controller through the input terminal 5 are then converted into 32-bit data by the serial/parallel converter section 2 in order to make them fit to the bit width of the input/output terminal 7 of the frame memory section 1.

The converted data are then temporarily stored in the FIFO memory section 3. The capacity of the FIFO memory section 3 may be selected arbitrarily. When the FIFO memory section 3 is full, the data stored there are read out at the same rate as the video signal input. The data read out from there are then written into the frame memory section 1 on a real time basis.

The operation of reading data out of the FIFO memory section 3 is conducted with a bit width four times greater than the video signal input rate of the video signal input terminal so that the time required for reading out the data will be only one fourth of the time required for writing the data. In other words, to write the data into the FIFO memory section 3 in full takes four times of the time to read them out of it.

Thus, the input/output terminal 7 of the frame memory section 1 will cyclically be set free for a period of time that is equal to three times of the period of time required for writing a given amount of data into the frame memory section 1. This time period is utilized to read the data stored in the frame memory section 1. Reading the data out of the frame memory section 1 can be conducted within the time period used to write them or within the doubled time period. With this technique, then, there still remains a period of time the frame memory section 1 is free, which is equal to the time period required for writing, other than the time period required for writing and reading out. If the frame memory section 1 is an SDRAM, this period of time can be used to precharge the memory or execute active commands because such operations are necessary for switching banks when accessing the memory continuously. The size of the FIFO 3 may be selected depending on the time required for executing such commands.

An SDRAM (synchronous dynamic random access memory) is a DRAM that can take in instructions and/or input/output data in synchronism with the system clock. While known DRAMs normally operate asynchronously relative to the system clock and hence require a cumbersome operation of designing the respective operation timings, an SDRAM is particularly adapted to burst operations for continuously outputting data in synchronism with the system clock as well as other operations to be conducted efficiently at high speed by separating the inside into a plurality of banks. For the purpose of the invention, the SDRAM of the frame memory section 1 may be replaced by an SGRAM (synchronous graphic RAM) that is realized by adding a block write feature of rewriting the amount of data of 8 columns in a single write cycle and a write per bit feature of writing image data on a bit by bit basis to an SDRAM as it performs excellently for processing graphics.

Figure 3:
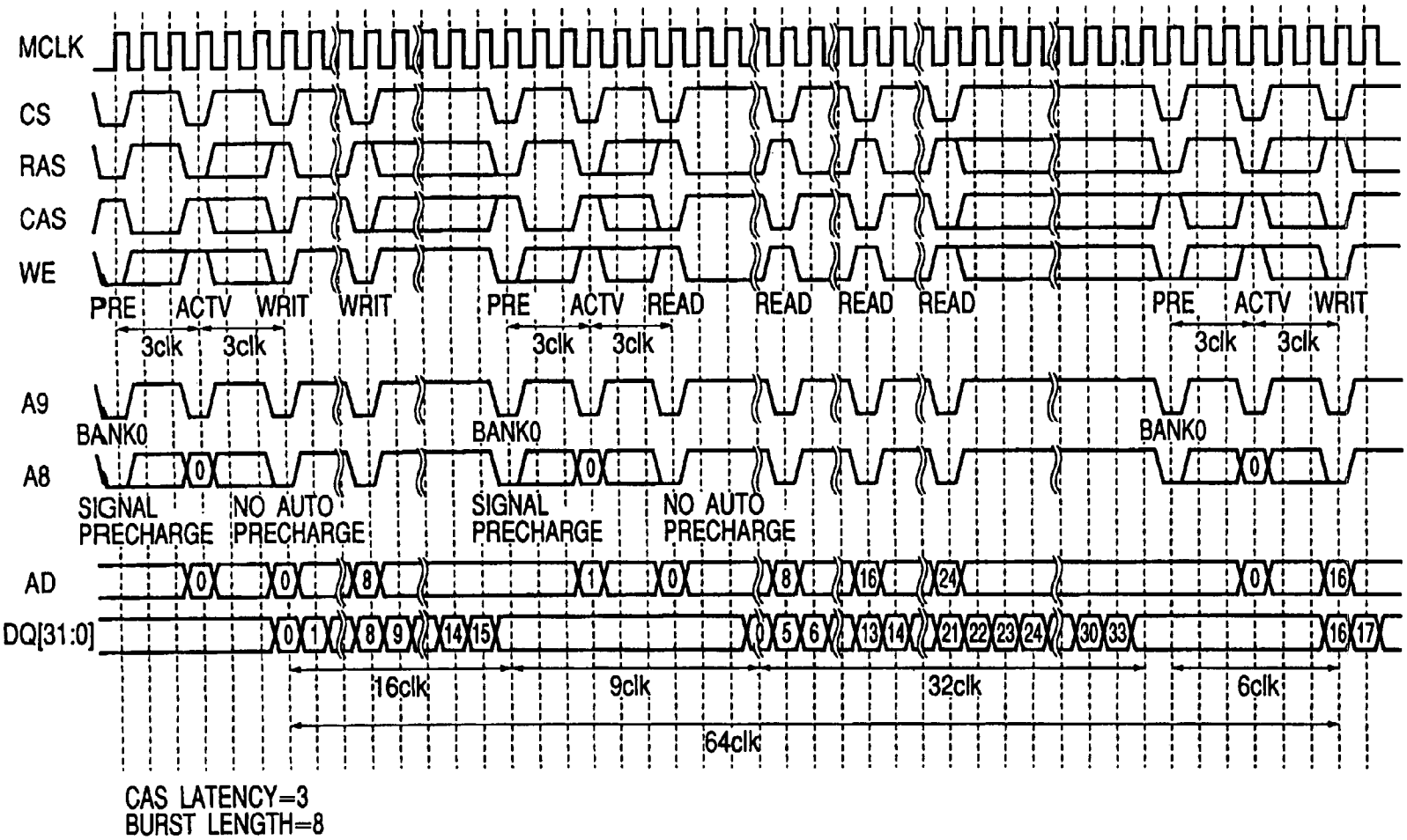
FIG. 3 is a timing chart that can be used for the frame memory of the embodiment of FIG. 1.

FIG. 3 shows a timing chart that can be used to access the SDRAM of the frame memory section of the embodiment of FIG. 1. Referring to FIG. 3, if the write address and the read address for the current cycle are located in a same bank but in different rows, each of them requires a precharging operation and a row active period to switch from write to read. Additionally, if the SDRAM is driven to operate at a maximum rate, CAS Latency=3 will be used.

For switching from a write operation to a read operation as shown in FIG. 3, a blank period equal to a total of 9 clock cycles will be required including 3 clock cycles from a precharge to an active command, 3 clock cycles from the active command to a read command and 3 clock cycles for getting to a read ready state. For switching from a read operation to a write operation, on the other hand, a blank period equal to a total of 6 clock cycles will be required including 3 clock cycles from a precharge to an active command and 3 clock cycles from the active command to a write command. Thus, the total period of time required for the two switching operations will be 9+6=15 clock cycles or more. The size of the FIFO memory section 3 will be minimized by making this time period equal to the time period for writing data into the frame memory section 1. If the burst length is 8, the time period for writing data into the frame memory section 1 will be equal to 16 clock cycles in view of the smallest multiple of the burst length and the time period necessary for the above commands.

Thus, the size of the FIFO memory section 3 will be at least 32 bits×16. Since the time for reading a given amount of data from the frame memory section 1 is twice of the time for writing that amount of data into the frame memory section 1, 32 clock cycles will be needed. Then, the size of the FIFO memory section 4 will be at least 32 bits×32. Therefore, the operation of reading data from and writing data into the SDRAM will be repeated cyclically with a period equal to 64 clock cycles.

As for the side of reading the data stored in the frame memory section 1, the read out data will be temporarily stored in the FIFO memory section 4. Thereafter, the data are converted into data having a bit width and a bit rate required to the output side by the output control section 11 before they are output through the video signal output terminal 6.

It will be appreciated that the above described effect can be obtained if a different burst length is selected.

It will also be appreciated that the above described effect can be obtained if the frame memory 1 is made to comprise a plurality of memories.

Second Embodiment

Now, a second embodiment of memory controller according to the invention will be described also by referring to FIG. 1.

Referring to FIG. 1, the frame memory section 1 is a memory having a feature of continuously accessible in synchronism with a clock such as SDRAM. The bit width of the input/output data terminal of the frame memory section 1 is equal to 2 n times of the bit width of the video signal input terminal 5. In this embodiment, the input terminal 5 has a bit width of 8 bits and the input/output data terminal has a bit width of 8×2n(n=4)=8×8=64.

The 8-bit data entered to the memory controller through the input terminal 5 are then converted into 64-bit data by the serial/parallel converter section 2 in order to make them fit to the bit width of the input/output terminal 7 of the frame memory section 1.

The converted data are then temporarily stored in the FIFO memory section 3. The capacity of the FIFO memory section 3 may be selected arbitrarily. When the FIFO memory section 3 is full, the data stored there are read out at a rate equal to a half of the video signal input rate. The data read out from there are then written into the frame memory section 1 on a real time basis. From then on, the rate of accessing the data in the frame memory section 1 will always be a half of the video signal input rate.

The operation of reading data out of the FIFO memory section 3 is conducted with a bit width eight times greater than the video signal input rate of the video signal input terminal so that the time required for reading out the data will be only one fourth of the time required for writing the data. In other words, to write the data into the FIFO memory section 3 in full takes four times of the time to read them out of it.

Thus, the input/output terminal 7 of the frame memory section 1 will cyclically be set free for a period of time that is equal to three times of the period of time required for writing a given amount of data into the frame memory section 1. This time period is utilized to read the data stored in the frame memory section 1. Reading the data out of the frame memory section 1 can be conducted within the time period used to write them or within the doubled time period. With this technique, then, there still remains a period of time the frame memory section 1 is free, which is equal to the time period required for writing, other than the time period required for writing and reading out. If the frame memory section 1 is an SDRAM, this period of time can be used to precharge the memory or execute active commands because such operations are necessary for switching banks when accessing the memory continuously. The size of the FIFO 3 may be selected depending on the time required for executing such commands. The method of accessing the SDRAM as described above for the first embodiment is applicable to the second embodiment.

As for the side of reading the data stored in the frame memory section 1, the read out data will be temporarily stored in the FIFO memory section 4. Thereafter, the data are converted into data having a bit width and a bit rate required to the output side by the output control section 11 before they are output through the video signal output terminal 6.

It will be appreciated that the above described effect can be obtained by making the period required for the commands of the frame memory 1 and the period required for writing the data in the frame memory 1 if a different burst length is selected.

It will also be appreciated that the above described effect can be obtained if the frame memory 1 is made to comprise a plurality of memories.

Third Embodiment

Figure 4:
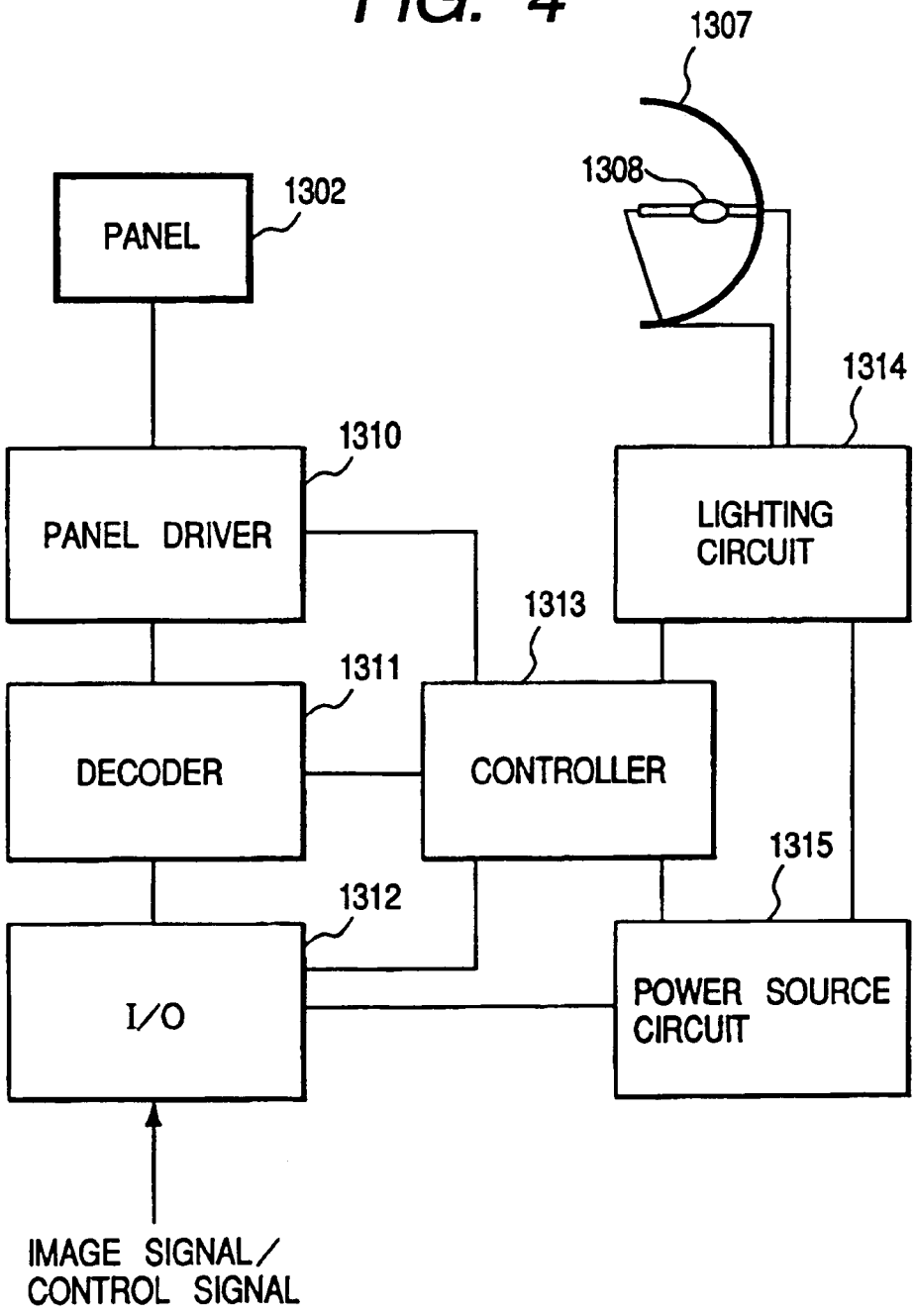
FIG. 4 is a schematic block diagram of the drive system of a projection type liquid crystal display apparatus adapted to use a memory controller according to the invention.

FIG. 4 is a schematic block diagram of the drive system of a projection type liquid crystal display apparatus adapted to use a memory controller according to the invention. In FIG. 4, reference numeral 1310 denotes a panel driver for inverting the polarity of RGB video signals and generating liquid crystal drive signals subjected to a predetermined voltage boosting operation as well as drive signals for the counter electrode and various timing signals. It will be appreciated that the panel driver also operates to regulate the DC level as described above by referring to the preceding embodiments. Reference numeral 1312 denotes an interface adapted to decode video signals and control/transmission signals into standard video signals. Reference numeral 1311 denotes a decoder for decoding/transforming standard video signals coming from the interface 1312 into video signals of the three primary colors of red (R), green (G) and blue (B) and synchronizing signals or video signals adapted to the liquid crystal panel of the apparatus. By using a memory controller as described above by referring to the first and second embodiments for the decoder 1311, data can be written into and read out from a memory on a continuous basis without suspending the input of video signals to enhance the level of freedom with which video signals can be processed and hence improve the quality and the resolution of the image displayed on the screen of the liquid crystal panel.

Reference numeral 1314 denotes a lightening circuit that operates as ballast and drives an arc lamp 1308 arranged within an elliptic reflector 1307 to turn it on and off. Reference numeral 1315 denotes a power source circuit for supplying power to the circuit blocks. Reference numeral 1313 denotes a controller comprising a control unit (not shown) for controlling the operations of the circuit blocks in a coordinated manner. Particularly; it issues instructions to the panel driver 1310 for polarity inversion, for indicating the number of fields by which the polarity is inverted to regulate the counter potential and for selecting the color to be used for the regulating operation. Thus, a projection type liquid crystal display apparatus according to the invention comprises a single panel type projector having a drive circuit system for illuminating the liquid crystal panel 1302 with white light from the arc lamp 1308 such as a metal halide lamp and projecting the video signals of the reflection type liquid crystal panel 1302 onto a large screen by way of an optical lens system (not shown) to display large images. Since a liquid crystal display apparatus according to the invention is free from flicker and a sticking phenomenon of the liquid crystal panel, it can display large and high quality images on the display screen.

With the above described arrangement, two horizontal scanning operations can be conducted simultaneously and video signals for two rows can be fed to the liquid crystal panel simultaneously by means of the memory controller used for the decoder 1311 to drive the panel comprising a large number of densely arranged pixels to display clear and high quality images.

ADVANTAGES OF THE INVENTION

As described above, according to the invention, there is provided a memory controller comprising a frame memory having a capacity only for a single frame and a FIFO memory having a minimal capacity that is adapted to write data into and read data from the frame memory on a continuous basis. Apparently such a memory controller costs minimally.

Then, the speed at which the data in the frame memory are accessed does not exceeds the video signal input rate and data for two frames can be written within a time period required for writing data for a single frame.

Additionally, as described above by referring to the second embodiment, the speed at which the data in the frame memory can be made less than a half of the video signal input rate to allow the use of a less costly frame memory that operates only at low speed so that the memory controller can be prepared at even more reduced cost.

What is claimed is:

1. A memory controller comprising:

a converter section adapted to perform serial/parallel conversion of input image data of "a" bit width into image data of "a"×"2n"-bit width, where "a" is a natural number representing a size of the inputted bit width and "n" is a natural number;

a first FIFO (first-in-first-out) section adapted to temporarily store the image data of "a"×"2n"-bit width;

a frame memory section adapted to store image data of one frame; and a second FIFO section adapted to temporarily store image data read out from said frame memory section, wherein the image data is read out from said first FIFO section at the time of completion of storage of the image data therein, written into said frame memory section at half of a rate at which the image data is inputted into said converter section, and read out from said frame memory section at a rate that is half of a rate at which the image data is inputted into said first FIFO section, wherein the time period for writing into the frame memory section is less than the time period during which the image data is stored in the first FIFO section, and in which the writing in and reading out of image data to and from the frame memory section is effected through a single input/output terminal, wherein said first FIFO section is of a size suitable for storing image data, so that, within a period for inputting the image data into said first FIFO section to FULL capacity, writing the image data into said frame memory section, reading the image data from said frame memory section, and executing a command of said frame memory section are conducted, and wherein successive frames of image data are successively written.

2. A liquid crystal display comprising:

a liquid crystal panel;

a decoder adapted to convert an inputted image signal into an image signal adaptable to said liquid crystal panel, wherein said decoder is provided with a memory controller according to claim 1.

* * * * *

UNITED STATES PATENT AND TRADEMARK OFFICE

CERTIFICATE OF CORRECTION

PATENT NO. : 7,023,413 B1
APPLICATION NO. : 09/177572
DATED : April 4, 2006
INVENTOR(S) : Yoshihiro Terashima et al.

It is certified that error appears in the above-identified patent and that said Letters Patent is hereby corrected as shown below:

Column 1

Line 36, “is” should read --are--; and “to raise” should read --, and this raises--.

Column 6

Line 50, “exceeds” should read --exceed--;
Line 51, “written” should read --read--; and
Line 54, “speed at which the data in” should read --access speed of--.

Signed and Sealed this

Twenty-fourth Day of October, 2006

JON W. DUDAS
*Director of the United States Patent and Trademark Office*